US005701816A

United States Patent [19]

Fujiwara et al.

[11] Patent Number: 5,701,816

[45] Date of Patent: Dec. 30, 1997

[54] HEAT-SENSITIVE TYPE MIMEOGRAPHIC SCREEN FORMING APPARATUS

[75] Inventors: Yuichi Fujiwara; Chikao Nakagawa; Hiromi Ito; Yoshinori Kobayashi, all of Yokohama, Japan

[73] Assignee: Graphtec Corporation, Kanagawa, Japan

[21] Appl. No.: 706,569

[22] Filed: Sep. 5, 1996

[30] Foreign Application Priority Data

Sep. 7, 1995 [JP] Japan ..... 7-255574

[51] Int. Cl.[6] ..... B41C 1/14

[52] U.S. Cl. ..... 101/128.4; 101/127.1

[58] Field of Search ..... 101/127.1, 128.21, 101/128.4

[56] References Cited

U.S. PATENT DOCUMENTS 3,528,335 9/1970 Andolsek ..... 101/260
5,384,585 1/1995 Okumura ..... 101/128.4

FOREIGN PATENT DOCUMENTS 0-689-934-A1 1/1996 European Pat. Off. .
94/21463 9/1994 WIPO .

*Primary Examiner*—Stephen R. Funk
*Attorney, Agent, or Firm*—Oliff & Berridge, P.L.C.

[57] ABSTRACT

A heat-sensitive type mimeographic screen forming apparatus includes: a long thermal head which covers a screen fabric spread on a screen fabric frame in its entirety; and a platen which is brought into contact with the thermal head through the screen fabric. Depending on the width of a screen fabric frame to be used, the platen is replaced with another suitable one, or changed in width.

6 Claims, 7 Drawing Sheets

HEAT-SENSITIVE TYPE MIMEOGRAPHIC SCREEN FORMING APPARATUS

BACKGROUND OF THE INVENTION

1. Field of the Invention

This invention relates to a heat-sensitive type mimeographic-screen forming apparatus which drives a thermal head to selectively heat a screen fabric which has been spread on a screen fabric frame, to form a mimeographic screen as a stencil.

2. Description of the Related Art

A heat-sensitive type mimeographic-screen forming apparatus is well known in the art which employs a thermal head which is brought into contact with a screen fabric spread on a screen fabric frame. The screen fabric frame is for instance a rectangular frame on which a screen fabric is spread tight. In this apparatus, a screen fabric as illustrated in FIG. 13 is generally used. That is, the heat-sensitive fabric (thermal screen) is obtained by making a heat-sensitive film 110 adhere to a screen fabric 100 with an adhesive 120, and the heat-sensitive screen fabric is then merely spread on the screen frame as it is for use. That is, the heat-sensitive screen fabric is imaginably in a state where emulsion has been coated on the fabric. Only the heat-sensitive film on the surface of the screen fabric is melted by the thermal head to form a hole. That is, a portion of the heat-sensitive film through which ink is allowed to pass is melted to form a hole, and a portion of the heat-sensitive film through which ink is not allowed to pass remains not melted, thereby being capable of forming a mimeographic screen.

In the conventional apparatus which forms the mimeographic-screen from the screen fabric spread on the frame, it has a flat plate of rubber and a serial type thermal head which is relatively small in effective width. The flat plate of rubber is fitted in the frame to support the screen fabric, thus being used as a platen. Also, the serial type thermal head is brought into contact with the screen fabric spread on the frame to form the mimeographic-screen.

The above-described conventional apparatus is disadvantageous in the following points: In the case where screen fabrics different in size are used, it is necessary to provide flat-plate platens different in size respectively for those different screen fabrics. Furthermore, with the apparatus employing the serial type thermal head, it is limited to increase the mimeographic screen forming speed.

In order to increase that speed, it may use a long thermal head instead of the serial thermal head. However, in this case, it should be noted as follows:

That is, since the screen fabric is spread on the frame, in the case where the thermal head is provided on the side of the right side of the screen fabric, the frame obstructs the setting of the platen on the reverse side of the screen fabric. On the other hand, in the case where the thermal head is set on the side of the reverse side of the screen fabric, the frame obstructs the setting of the thermal head.

SUMMARY OF THE INVENTION

Accordingly, an object of the invention is to eliminate the above-described difficulties accompanying a conventional heat-sensitive type mimeographic screen forming apparatus.

In order to solve the above difficulties, in a heat-sensitive type mimeographic screen forming apparatus of the invention, a thermal head is provided the length of which corresponds to the width of the widest among a plurality of screen fabric frames to be used, and its platen is replaced with another one or changed in width depending on the width of a screen fabric frame to be used, and the thermal head and the platen are moved with respect to the screen fabric in a synchronization mode.

In the apparatus of the invention, the thermal head and the platen are moved in a synchronization mode, and the platen is replaceable with another one or changed in width according to the width of a screen fabric frame to be used. This feature relieves the limitation to the use of screen fabrics. Furthermore, since the long thermal head is used, the mimeographic screen forming speed is increased as much.

The above and other objects and features of the present invention will be more apparent from the following description taken in conjunction with the accompanying drawings.

BRIEF DESCRIPTION OF THE PREFERRED EMBODIMENTS

DETAILED DESCRIPTION OF THE PREFERRED EMBODIMENTS

Preferred embodiments of the invention will be described with reference to the accompanying drawings.

Figure 7:
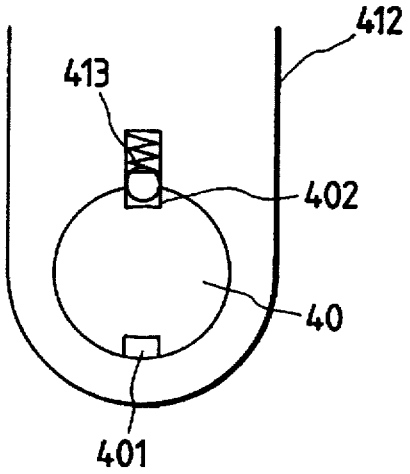
FIG. 7 is an explanatory diagram for a description of the setting of the platen in the apparatus shown in FIG. 5.
Figure 8:
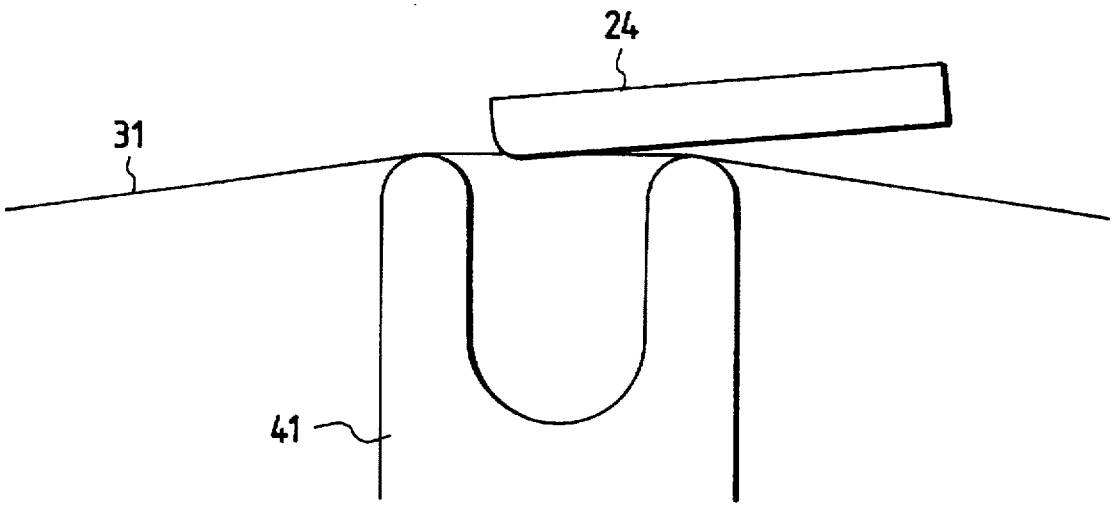
FIG. 8 is an explanatory diagram for a description of the relationships between a thermal head and the platen in the apparatus shown in FIG. 5.
Figure 9:
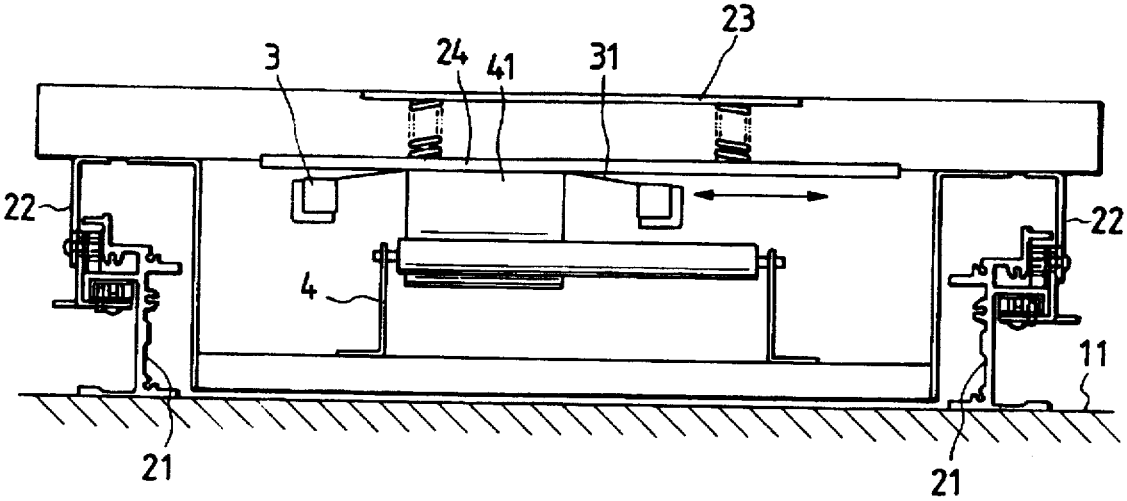
FIG. 9 is an explanatory diagram showing the arrangement of essential components of another example of the heat-sensitive type mimeographic screen forming apparatus according to a third embodiment of the invention.
Figure 10:
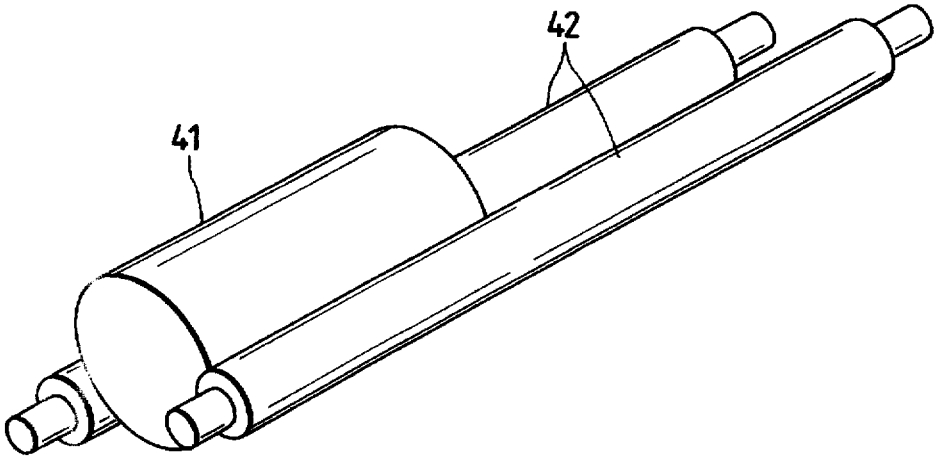
FIG. 10 is a perspective view for a description of the supporting of a platen in the apparatus shown in FIG. 9.
Figure 11:
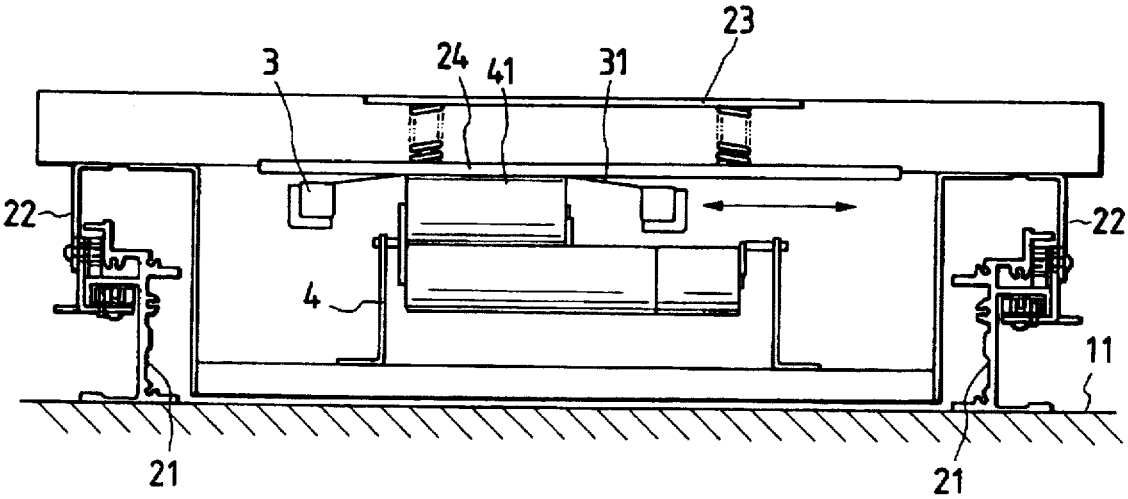
FIG. 11 is an explanatory diagram showing the arrangement of essential components of another example of the heat-sensitive type mimeographic screen forming apparatus according to a fourth embodiment of the invention.
Figure 12:
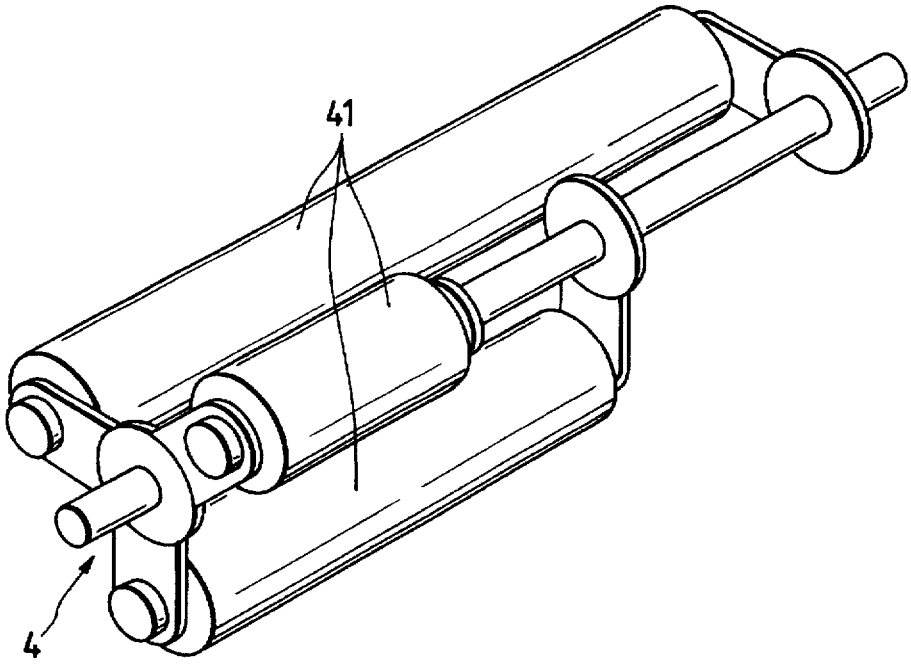
FIG. 12 is a perspective view for a description of the supporting of a platen assembly in the apparatus shown in FIG. 11.
Figure 13:
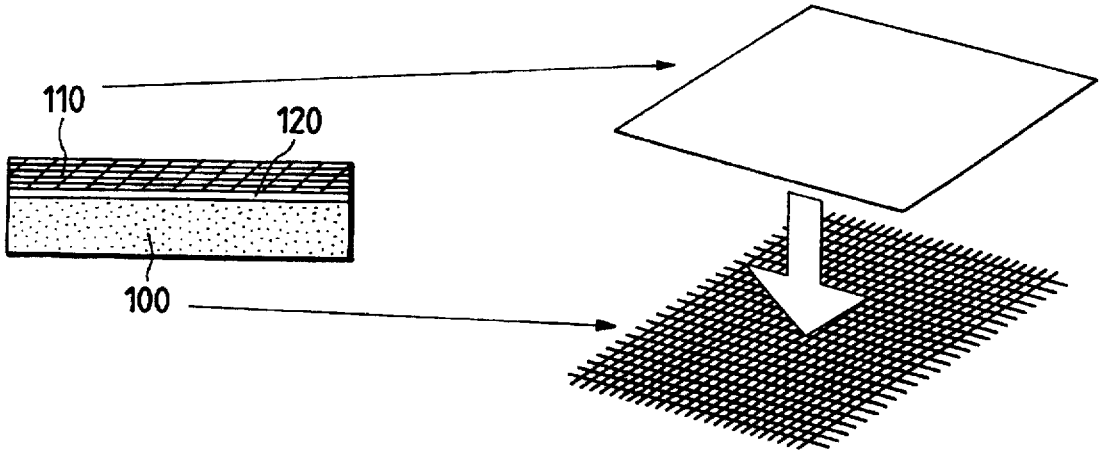
FIG. 13 is an explanatory diagram showing a heat-sensitive fabric screen used in the heat-sensitive type mimeorgraphic screen forming apparatus.

FIGS. 1 to 12 show the embodiments of the invention. More specifically, FIGS. 1 to 4 show an example of a heat-sensitive type mimeographic screen forming apparatus according to a first embodiment of the invention; FIGS. 5 to 8 show another example of the heat-sensitive type mimeographic screen forming apparatus according to a second embodiment of the invention; FIGS. 9 and 10 show still another example of the heat-sensitive type mimeographic screen forming apparatus according to a third embodiment of the invention; and FIGS. 11 and 12 show yet still another example of the heat-sensitive type mimeographic screen forming apparatus according to a fourth embodiment of the invention. In those figures, reference numeral 1 designates the heat-sensitive type mimeographic screen forming apparatus; 2, a mimeographic-screen-forming-member moving mechanism; 3, a screen fabric frame; and 4, a platen holding mechanism.

(First Embodiment)

The first embodiment of the invention will be described with reference to FIGS. 1 to 4.

Figure 1:
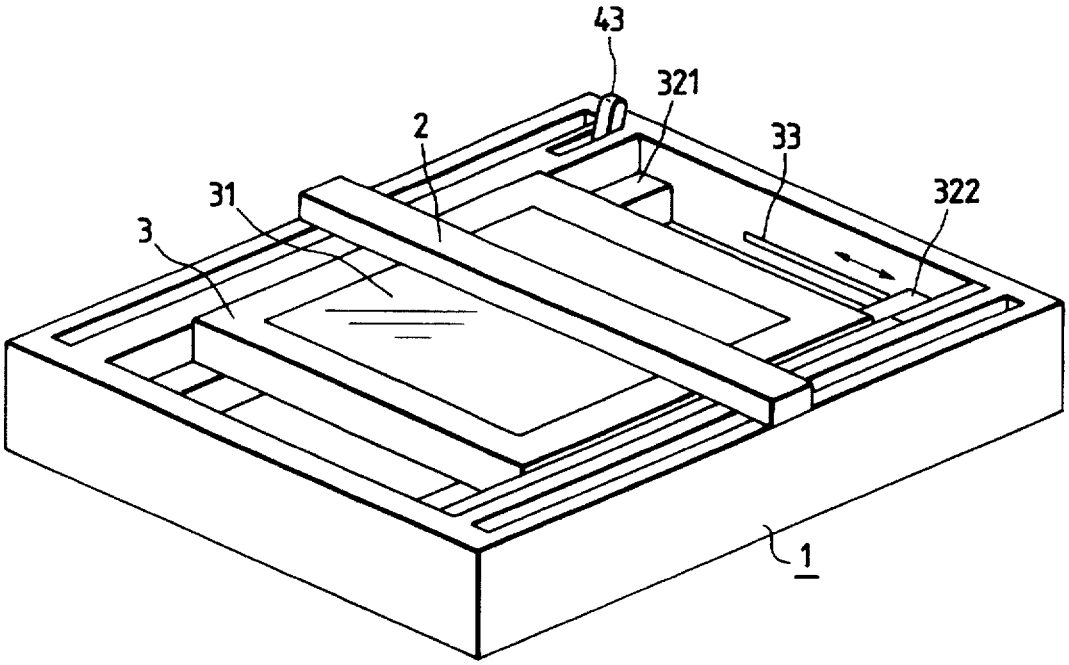
FIG. 1 is a perspective view showing an external appearance of an example of a heat-sensitive type mimeographic screen forming apparatus according to a first embodiment of the invention.

FIG. 1 is a perspective view showing an external appearance of the heat-sensitive type mimeographic screen forming apparatus. In the apparatus, the screen fabric frame 3 is fixedly positioned by a screen fabric frame holding mechanism 321 and 322. A thermal head 24 (FIG. 2) for forming a mimeographic screen is mounted in the mimeographic-screen-forming-member moving mechanism 2 and urged downwardly by springs. The mechanism 2 is moved longitudinally of the screen fabric 31 spread on the screen fabric frame 3. On the other hand, a printing image holding device (not shown) outputs an image signal, which is applied to the thermal head 24 so as to form a mimeographic-screen.

Figure 2:
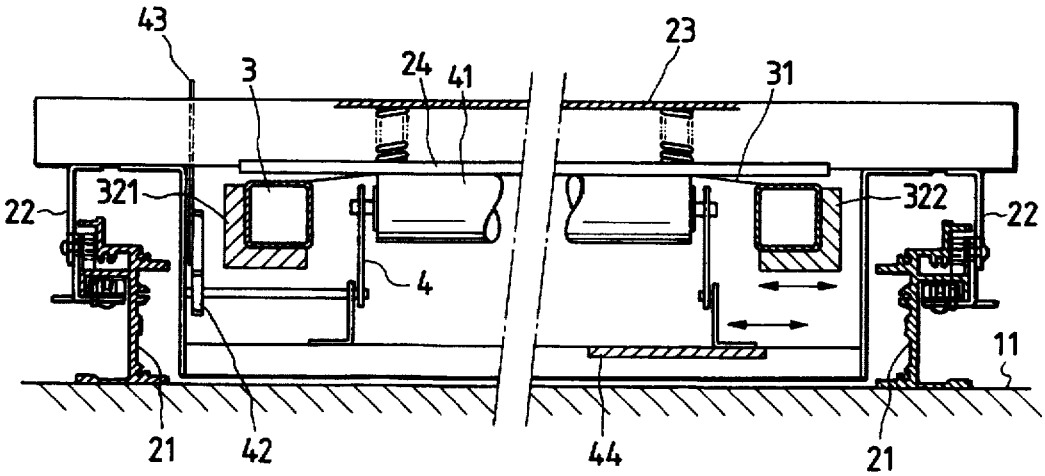
FIG. 2 is an explanatory diagram for a description of the arrangement of essential components of the apparatus shown in FIG. 1.

As shown in FIG. 2, the mimeographic-screen-forming-member moving mechanism 2 has a pair of slide members 22 which are guided by a pair of guide rails 21 mounted on the base stand 11 of the body of the apparatus. A head holding member 23 holding the thermal head 24, and the platen holding mechanism 4 are coupled to the slide members 22. The slide members 22 are coupled to electric motors (not shown), respectively, and in response to a movement instruction from the printing image holding device they are moved longitudinally of the screen fabric 31 in synchronization with each other.

Figure 3:
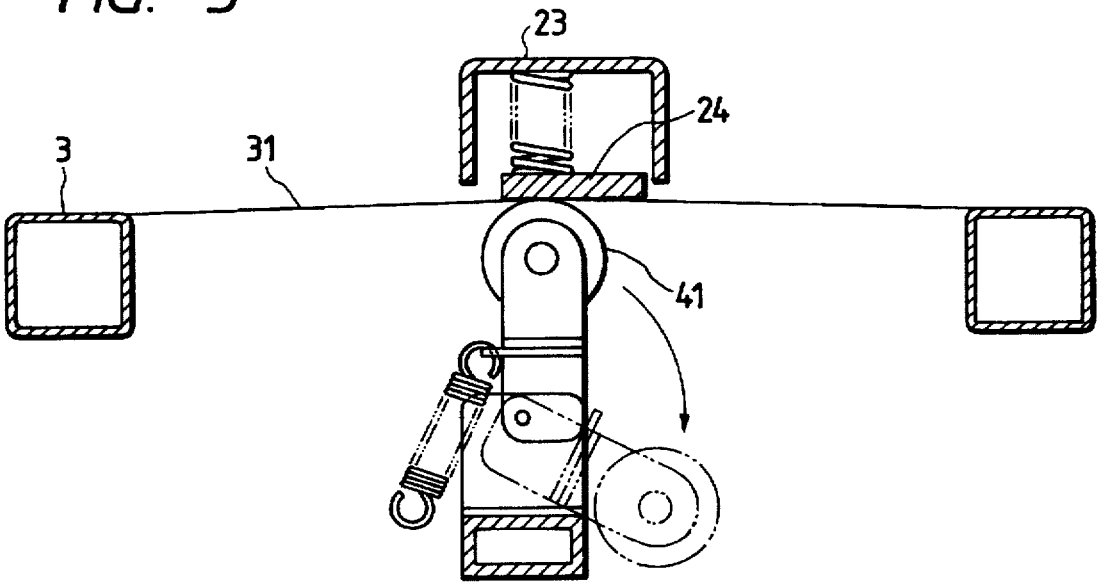
FIG. 3 is an explanatory diagram for a description of the relationships between a thermal head and a platen in the apparatus shown in FIG. 1.

The platen holding mechanism 4 comprises: a platen 41; a gear mechanism 42 for moving up and down the platen 41; a swinging lever 43 coupled to the gear mechanism 42; and a slide guide 44. The platen 41 is rotatably supported by the platen holding mechanism 4 so that it is rotated when moved together with the thermal head 24 with the screen fabric 31 held between them under a predetermined pressure. In addition, the platen 41 is coupled to the swinging lever 43 through the gear mechanism 42. Furthermore, the apparatus is so designed that, for instance when it is required to replace the screen fabric 3 with a new one, the platen 41 of the platen holding mechanism 4 can be set at a lower position as shown in FIG. 3 by operating the swinging lever 43.

Figure 4:
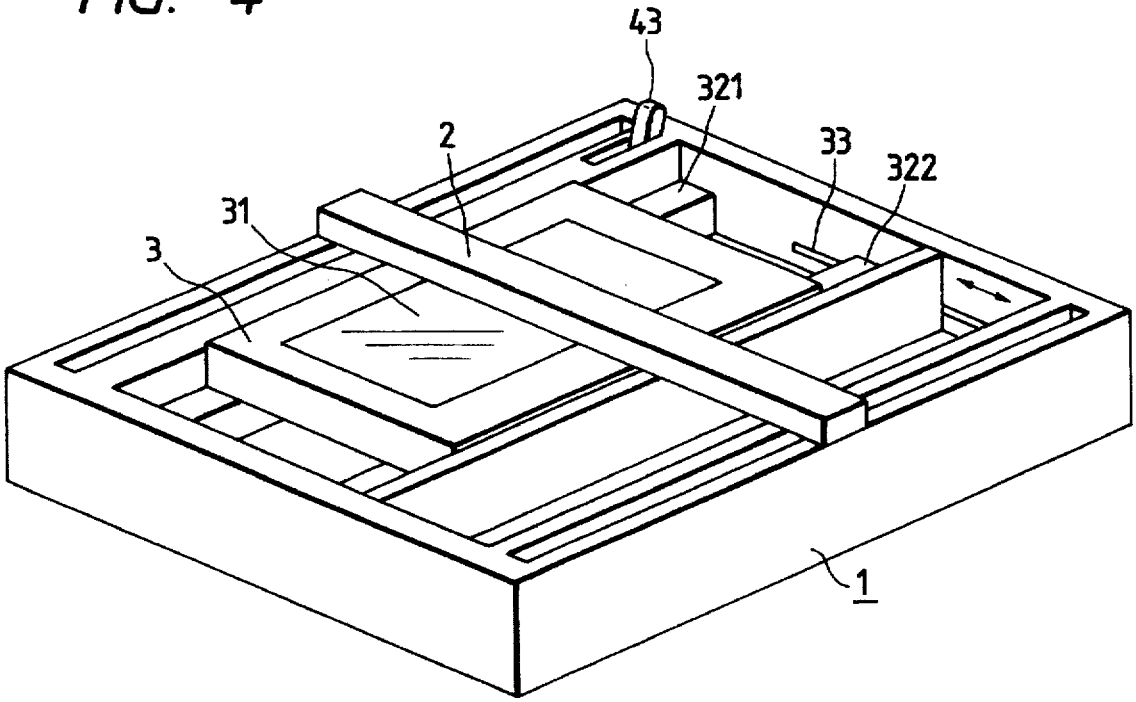
FIG. 4 is a perspective view for a description of the mimeographic screen forming operation of the apparatus shown in FIG. 1 in the case where a screen fabric frame to be used is small in width.

The platen 41 is supported by a first holding section 411 and a second holding section 412. The holding section 412 on the right side is so designed that it is slidable in the direction of arrangement of the thermal head 24 whereby in the case of using another screen fabric frame (3) smaller in width than the present screen fabric frame 3, the platen 41 may be replaced with a platen (41) smaller in width. In this connection, a movable-side screen fabric holding mechanism 322 is provided slidably along a guide groove 33 as shown in FIG. 4; that is, this holding mechanism 322 is slid according to the width of the new screen fabric frame 3.

(Second Embodiment)

The second embodiment of the invention will be described with reference to FIGS. 5 through 8.

Figure 5:
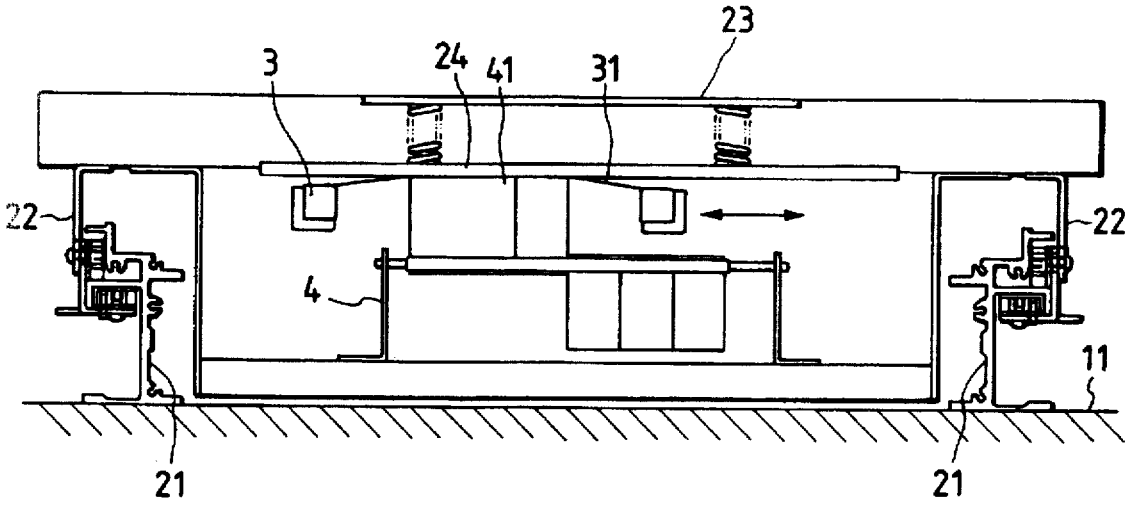
FIG. 5 is an explanatory diagram showing the arrangement of essential components of another example of the heat-sensitive type mimeographic screen forming apparatus according to a second embodiment.
Figure 6:
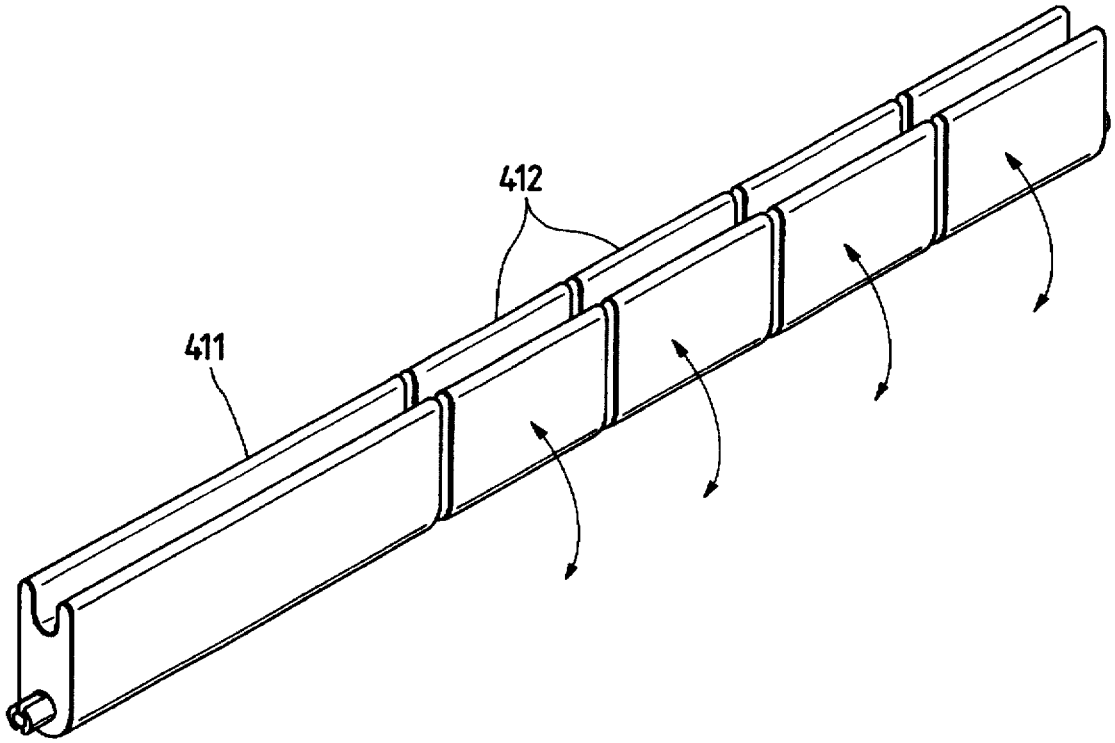
FIG. 6 is a perspective view of a platen employed in the apparatus shown in FIG. 5.

The second embodiment is different from the above-described first embodiment in the structure of its platen 41. As shown in FIG. 6, the platen 41 is made up of one stationary platen unit 411 relatively larger in width, and a plurality of movable platen units 412 which are each smaller in width than the stationary platen unit 411 and arranged in alignment with the latter 411. Those platen units 411 and 412 have U-shaped grooves in the upper end faces, respectively. The movable platen units 412 each have a rise position and a fall position. That is, as shown in FIG. 5, the movable platen units are selectively set at the rise positions and/or at the fall positions, thereby to adjust the width of the platen 41 as a whole.

Each of the movable platen units 412, as shown in FIG. 7, has an engaging key 413, and is fitted on a platen holding shaft 40 which has two engaging grooves 401 and 402 in correspondence to the rise position and the fall position of the movable platen unit 412. Hence, as the movable platen unit 412 is turned, it is set at the rise position or the fall position.

The upper end faces of those stationary and movable platen units 411 and 412 which are brought into contact with the screen fabric 31 are U-shaped in section. Hence, as shown in FIG. 8, the thermal head 24 abuts against the screen fabric 31 which is supported by the two protrusions U-shaped in section of each of the platen units 411 and 412, so that the screen fabric 31 is suitably spread. Hence, the resultant mimeographic screen is satisfactory in quality.

(Third Embodiment)

The third embodiment of the invention is as shown in FIGS. 9 and 10.

The third embodiment is different from the above-described first and second embodiment in that its platen 41 is supported by a pair of platen supporting rollers 42 as shown in FIG. 10. This arrangement is advantageous in that, when the platen 41 is replaced with a new one which is different in width from the platen 41, the new platen can be readily centered (so that it is correctly brought into contact with the heat generating part of the thermal head).

(Fourth Embodiment)

The fourth embodiment of the invention will be described with reference to FIGS. 11 and 12.

The fourth embodiment is different from the above-described first through third embodiment in that, as shown in FIG. 12, a platen holding mechanism 4 is provided which supports three platens 41 different in length from one another (hereinafter referred to as "a platen assembly 41", when applicable). The platen holding mechanism 4 is rotatably provided so that those three platens 41 are positioned at their operating positions, respectively. With the fourth embodiment, when compared with the first through third embodiments, replacement of the platen 41 can be achieved readily.

In each of the above-described embodiments, the platen 41 pushes the screen fabric 31 upwardly which is spread on the screen fabric frame 3, so that the top portion of the screen fabric 31 thus pushed upwardly is brought into contact with the heat generating part of the thermal head 24. Hence, the apparatus thus designed can employ a thermal head which is long enough to cover the whole screen fabric frame.

The heat-sensitive type mimeographic screen forming apparatus of the invention employs the long thermal head to form a mimeographic screen according to the line printing system. Hence, with the apparatus, the mimeographic-screen high in quality having no breaks of an image nor joints of images can be obtained. Furthermore, the apparatus is high in mimeographic screen forming speed. Moreover, in the apparatus, when necessary, the platen may be replaced or changed in width according to the width of a screen fabric frame to be used. Hence, with the apparatus of the invention, screen fabric frames different in width may be used to form mimeographic screens.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention.

For example, instead of moving the thermal head and the platen in synchronization, the screen fabric frame may be moved.

These above-mentioned embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A heat-sensitive type mimeographic screen forming apparatus, comprising:

a screen fabric frame;

a screen fabric spread on said screen fabric frame;

a platen which corresponds in length to an inside width of said screen fabric frame;

a thermal head for selectively heating said screen fabric supported by said platen to form a mimeographic screen according to an image signal;

means for supporting said thermal head which corresponds in length to the width of said screen fabric spread on said screen fabric frame, in such a manner that said thermal head is confronted with said screen fabric spread on said screen fabric frame;

means for supporting said platen, in such a manner that said platen pushes said screen fabric upwardly which is spread on said screen fabric frame, so that a top portion of said screen fabric thus pushed upwardly is brought into contact with a heat generation part of said thermal head;

means for relatively moving said thermal head and said platen in synchronization with respect to said screen fabric held between them; and means for driving said thermal head and said moving means for forming said mimeographic-screen according to signals from an image holding device.

2. An apparatus as claimed in claim 1, further comprising means for changing a width of said platen according to a width of said screen fabric to be used.

3. An apparatus as claimed in claim 2, wherein said platen comprises a stationary platen unit relatively large in width, and a plurality of movable platen units which are each smaller in width than said stationary platen unit and arranged in alignment with said stationary platen unit;

wherein said changing means selectively sets said movable platen units at rise positions to align with said stationary platen unit and at fall positions, to adjust the width of said platen as a whole.

4. An apparatus as claimed in claim 3, wherein said stationary and movable platen units have U-shaped grooves in upper end faces thereof.

5. An apparatus as claimed in claim 2, further comprising a pair of platen support rollers for said platen.

6. An apparatus as claimed in claim 2, wherein said platen comprising a plurality of platen units each having a different width, and said changing means comprises a platen holding mechanism for rotatably holding said plurality of platen units.

* * * * *